US010665138B1

(12) United States Patent
Chan

(10) Patent No.: US 10,665,138 B1
(45) Date of Patent: May 26, 2020

(54) COSMETIC DISPLAY ASSEMBLY

(71) Applicant: RETAIL SOLUTION CENTER, Freeport, NY (US)

(72) Inventor: Anthony Chan, Bethpage, NY (US)

(73) Assignee: RETAIL SOLUTION CENTER, Freeport, NY (US)

( * ) Notice: Subject to any disclaimer, the term of this patent is extended or adjusted under 35 U.S.C. 154(b) by 0 days.

(21) Appl. No.: 16/506,238

(22) Filed: Jul. 9, 2019

(51) Int. Cl.

| | |
|---|---|
| ***H01R 13/60*** | (2006.01) |
| ***G09F 9/35*** | (2006.01) |
| ***H01R 13/62*** | (2006.01) |
| ***G09F 9/33*** | (2006.01) |
| ***H01R 31/02*** | (2006.01) |
| ***H01R 43/26*** | (2006.01) |
| ***H01R 13/73*** | (2006.01) |

(52) U.S. Cl.
CPC ..... *G09F 9/35* (2013.01); *G09F 9/33* (2013.01); *H01R 13/6205* (2013.01); *H01R 13/73* (2013.01); *H01R 31/02* (2013.01); *H01R 43/26* (2013.01)

(58) Field of Classification Search
CPC .... H01R 13/6205; H01R 13/73; H01R 31/02; H01R 43/26; G09F 9/33; G09F 9/35
USPC ..... 439/39
See application file for complete search history.

(56) References Cited

U.S. PATENT DOCUMENTS 4,684,182 A * 8/1987 Gussman ..... H01L 21/67271 29/829
4,978,949 A * 12/1990 Herron ..... G06F 1/1616 345/168
5,264,992 A * 11/1993 Hogdahl ..... G06F 1/1626 16/334
5,677,830 A * 10/1997 Nogas ..... H05K 5/0021 361/732
5,914,698 A * 6/1999 Nicholson ..... G06F 3/147 340/908.1
6,027,828 A * 2/2000 Hahn ..... H01M 2/1022 429/100
6,282,082 B1 * 8/2001 Armitage ..... G06F 1/16 312/223.2
7,196,836 B2 * 3/2007 Bauer ..... B60R 1/088 359/265
7,499,282 B1 * 3/2009 Loucks ..... G06F 1/1626 361/730
7,963,773 B2 * 6/2011 Palli ..... H01R 13/6205 439/38
8,006,435 B2 * 8/2011 DeBlonk ..... A63B 71/06 16/369

(Continued)

FOREIGN PATENT DOCUMENTS

DE 19903483 A1 8/2000
DE 102016113419 A1 1/2018

(Continued)

*Primary Examiner* — Abdullah A Riyami
*Assistant Examiner* — Vladimir Imas
(74) *Attorney, Agent, or Firm* — Robert P. Michal, Esq.; Carter, DeLuca & Farrell LLP

(57) ABSTRACT

A cosmetic display assembly includes first, second, and third display panels. The first and second display panels are configured to be stacked along a vertical axis and electromechanically coupled to one another. The third display panel has a post configured for receipt in an electrical receptacle of the first display panel.

16 Claims, 7 Drawing Sheets

(56) References Cited

U.S. PATENT DOCUMENTS

| | | | | |
|---|---|---|---|---|
| 8,169,684 | B2 * | 5/2012 | Bugno | B60R 1/088 359/265 |
| 8,509,863 | B2 * | 8/2013 | Vedurmudi | H04M 1/0274 455/557 |
| 8,633,916 | B2 * | 1/2014 | Bernstein | G06F 3/016 345/174 |
| 8,824,125 | B1 * | 9/2014 | Cox | G09F 9/33 361/622 |
| 8,826,572 | B2 * | 9/2014 | Kaoh | G09F 27/005 40/544 |
| 8,905,610 | B2 * | 12/2014 | Coleman | G02B 6/0075 362/554 |
| 9,041,663 | B2 * | 5/2015 | Westerman | G06F 3/041 345/173 |
| 9,056,584 | B2 * | 6/2015 | Fish, Jr. | B60R 1/025 |
| 9,071,809 | B2 * | 6/2015 | Cope | H04N 21/41415 |
| 9,214,101 | B2 * | 12/2015 | Richmond | G09F 9/33 |
| 9,338,836 | B2 * | 5/2016 | Chien | H05B 33/08 |
| 9,357,858 | B2 | 6/2016 | Sun | |
| 9,655,267 | B2 * | 5/2017 | Cope | H05K 7/14 |
| 9,761,157 | B2 * | 9/2017 | Cox | G09F 9/3026 |
| 10,001,816 | B2 * | 6/2018 | Kim | G06F 1/1616 |
| 2003/0007321 | A1 * | 1/2003 | Dayley | G06F 1/181 361/679.6 |
| 2015/0070928 | A1 | 3/2015 | Rau | |

FOREIGN PATENT DOCUMENTS

| | | | |
|---|---|---|---|
| EP | 3238440 | A1 | 11/2018 |
| WO | 2012109099 | A2 | 8/2012 |

* cited by examiner

COSMETIC DISPLAY ASSEMBLY

BACKGROUND

The disclosure relates to electronic displays and, more particularly, to easily assembled electronic displays for displaying cosmetics.

Stores selling cosmetics may have display units for supporting various cosmetic products thereon, such as, for example, lipsticks, perfume, mascara, nail varnishes etc. The display provides a surface or surfaces on which the products may be marketed to potential buyers.

SUMMARY

In accordance with an aspect of the disclosure, a cosmetic display assembly is provided and includes first, second, and third display panels. The first display panel includes a first female connector or a first male connector, an electrical connector, and an electrical receptacle. The second display panel has the other of the first female connector or the first male connector, and an electrical connector configured to couple to the electrical connector of the first display panel. The first and second display panels are configured to be stacked along a vertical axis. The third display panel has a post extending downwardly therefrom. The post is configured for receipt in the electrical receptacle of the first display panel.

In aspects, the first male connector may project from an upper surface of the first display panel, and the first female connector may be an opening defined in a lower surface of the second display panel.

In aspects, the first male connector and the electrical connector of the first display panel may be aligned along a horizontally-extending longitudinal axis defined by the first display panel.

In aspects, the first display panel may include a second male connector. The electrical connector of the first display panel may be disposed between the first and second male connectors.

In aspects, each of the first, second, and third display panels may be an LED-backlit LCD.

In aspects, the first male connector may have a triangular configuration, and the first female connector may have a triangular configuration.

In aspects, the first display panel may have a first width, and the second display panel may have a second width, less than the first width of the first display panel.

In aspects, each of the first, second, and third display panels may have a memory having stored therein instructions for displaying an image.

In aspects, the first display panel may have an electrical port configured to receive and transfer power directly to the third display panel. The electrical port may be configured to transfer power to the second display panel via an electromechanical connection between the first and second display panels.

In aspects, the first display panel may define a cavity in an upper surface thereof, and the second display panel may have an extension extending downwardly from a lower surface thereof. The extension may be configured for complementary receipt in the cavity.

In aspects, the electrical connector of each of the first and second display panels may be a barrel connector.

In aspects, the electrical connector of each of the first and second display panels may be magnetic, such that the electrical connectors are magnetically attracted to one another.

In accordance with another aspect of the disclosure, a method of assembling a cosmetic display assembly is provided and includes positioning a second display panel above a first display panel; inserting first and second male connectors of the first display panel or the second display panel into respective first and second female connectors of the other of the first display panel or the second display panel; connecting a first electrical connector of the first display panel with a second electrical connector of the second display panel, thereby creating an electromechanical connection between the first and second display panels; and inserting a support post of a third display panel into an electrical receptacle of the first display panel, thereby creating an electromechanical connection between the first and third display panels.

In aspects, the method may further include inserting an extension extending downwardly from a lower surface of the second display panel into a cavity defined in an upper surface of the first display panel.

In aspects, the method may further include connecting an electrical port of the first display panel with a source of power, whereby electricity is transferred from the first display panel to the second and third display panels.

In aspects, the first and second electrical connectors may be magnetic, such that the first and second electrical connectors are magnetically attracted to one another.

As used herein, the terms parallel and perpendicular are understood to include relative configurations that are substantially parallel and substantially perpendicular up to about +/−10 degrees from true parallel and true perpendicular.

To the extent consistent, any of the aspects described herein may be used in conjunction with any or all of the other aspects described herein.

BRIEF DESCRIPTION OF THE DRAWINGS

Various aspects and features of the disclosure are described hereinbelow with reference to the drawings wherein like numerals designate identical or corresponding elements in each of the several views.

DETAILED DESCRIPTION

Figure 1A:
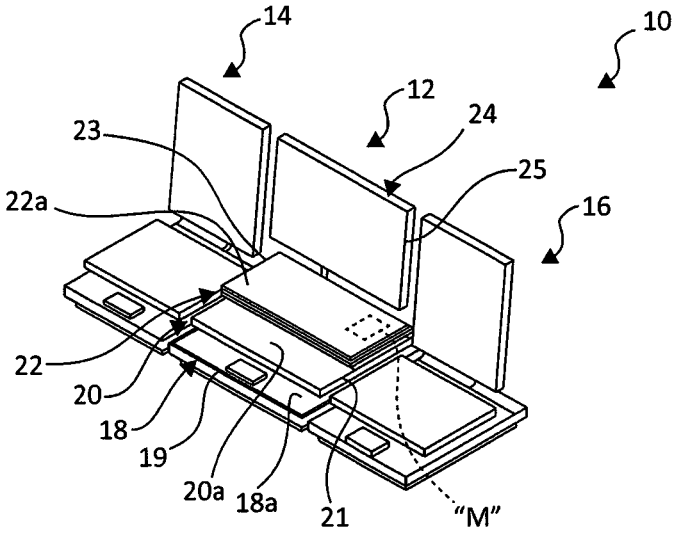
FIG. 1A is a front perspective view illustrating an embodiment of a cosmetic display assembly including a middle display assembly and a pair of lateral display assemblies on either side of the middle display assembly.
Figure 1B:
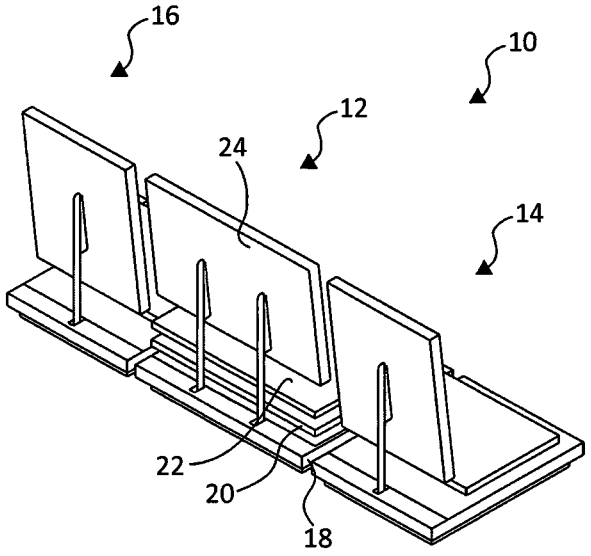
FIG. 1B is a rear perspective view illustrating the cosmetic display assembly of FIG. 1A

FIGS. 1A and 1B illustrate a display assembly 10 for displaying various types of cosmetics, such as, for example, makeup, perfume, skin care products, etc. In aspects, the display assembly 10 may be used for displaying any suitable consumer product. The display assembly 10 generally includes a middle display assembly 12 and first and second lateral display assemblies 14, 16 disposed on opposite sides of the middle display assembly 12. It is contemplated that the first and second lateral display assemblies 14, 16 may be electrically connected to the middle display assembly 12. Since each of the display assemblies 12, 14, 16 are substantially similar, only the middle display assembly 12 will be described in detail herein.

The display assembly 12 generally includes a plurality of horizontally-disposed display panels 18, 20, 22 and a single vertically-disposed display panel 24. Each of the display panels 18, 20, 22, 24 includes a flat-panel display panel 19, 21, 23, 25, such as, for example, an LED panel, an LED-backlit LCD, a plasma panel, an ELD panel, or the like. The LED panels 19, 21, 23, 25 each have a sheet of transparent material (e.g., glass) for allowing light emitted from the respective LED panel 19, 21, 23, 25 to pass therethrough. In aspects, the sheet of transparent material may be removable to allow for the insertion of a duratrans (not shown) or any other suitable graphic. Each of the display panels 18-24 may include one or more electrical clips (female and/or male) for the respective LED panels 19, 21, 23, 25.

A first horizontal display panel 18 may function as the base of the display assembly 12 and has a flat, rectangular shape to be supported on a flat surface. A second horizontal display panel 20 is configured to be stacked on the first display panel 18, and a third horizontal display panel 22 is configured to be stacked on the second display panel 20. In aspects, the middle display assembly 12 may include more or less than three horizontal display panels.

The tiered or stacked display panels 18, 20, 22 may each have a different width, such that upon stacking the horizontal display panels, a front end portion 18*a* of the first display panel 18 protrudes from a front end portion 20*a* of the second display panel 20, and the front end portion 20*a* of the second display panel 20 protrudes from a front end portion 22*a* of the third display panel 22. Each of the display panels 18, 20, 22 may have a memory "M" having stored therein instructions for displaying a discrete image, such as, for example, a single image, a plurality of images, or a video. In aspects, the third display panel 22 may be a video screen.

Figure 2:
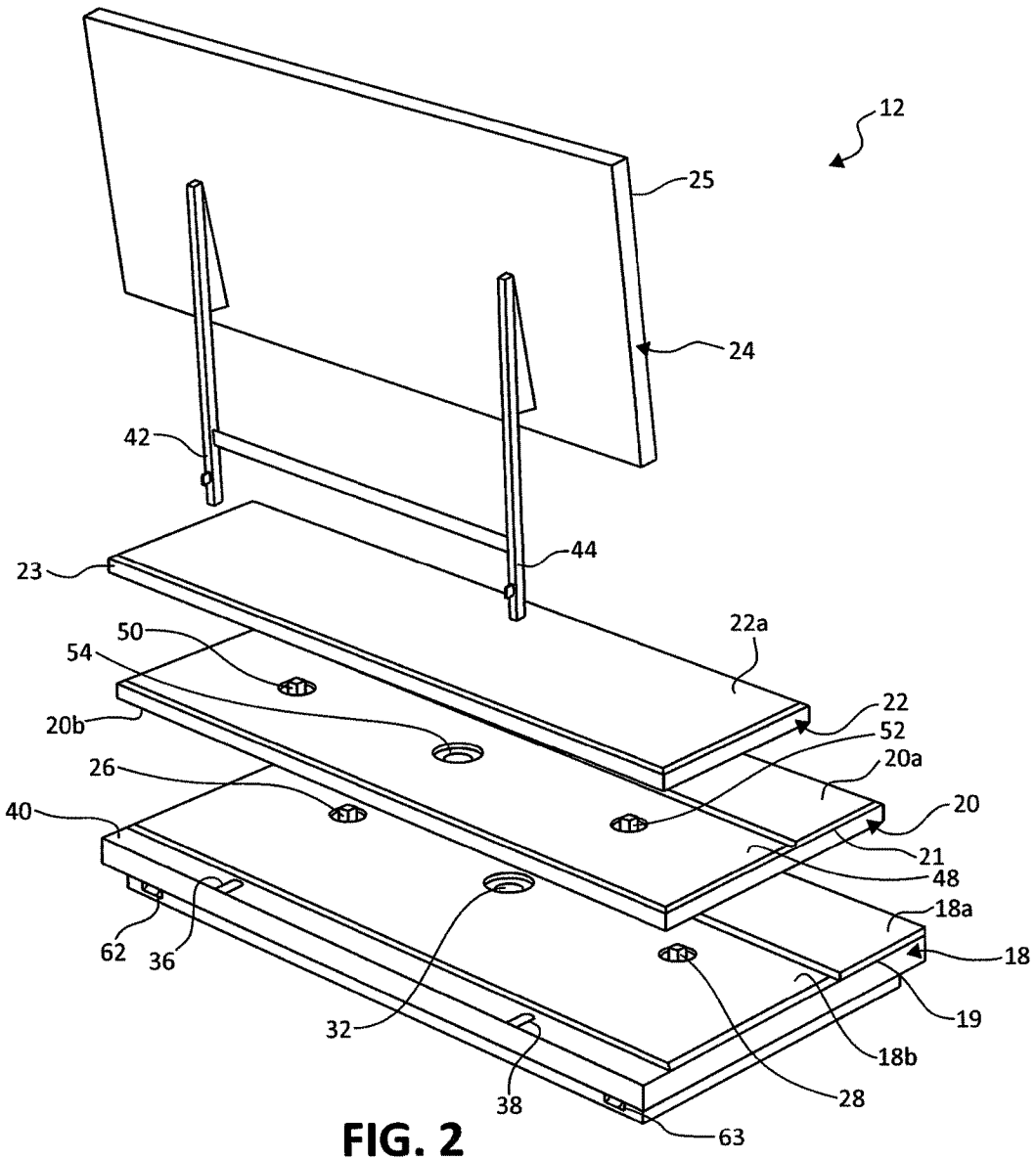
FIG. 2 is a rear perspective view, with parts separated, of the middle display assembly of FIG. 1B.
Figure 3:
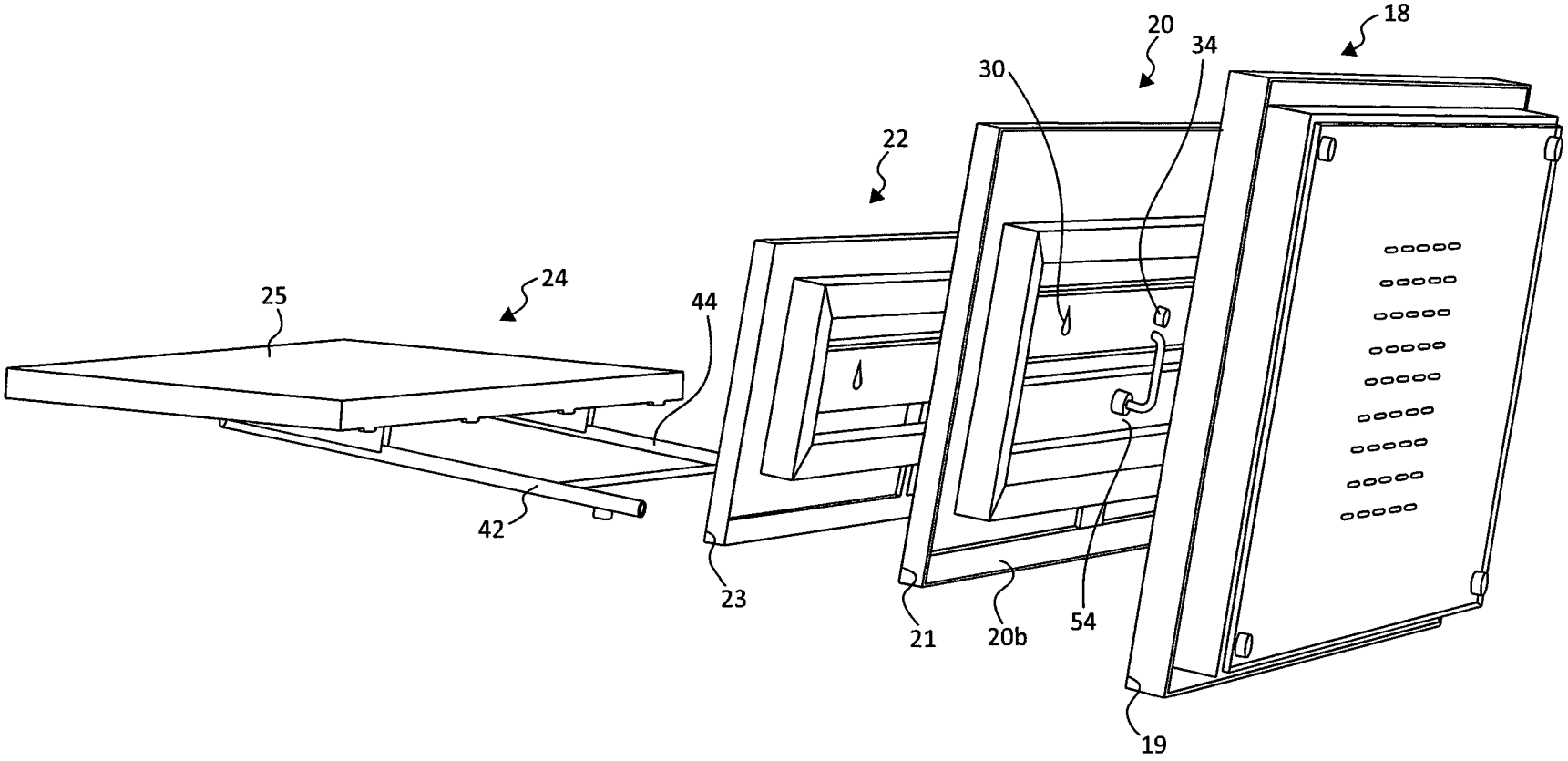
FIG. 3 is a bottom perspective view, with parts separated, of the middle display assembly of FIG. 1A.
Figure 3A:
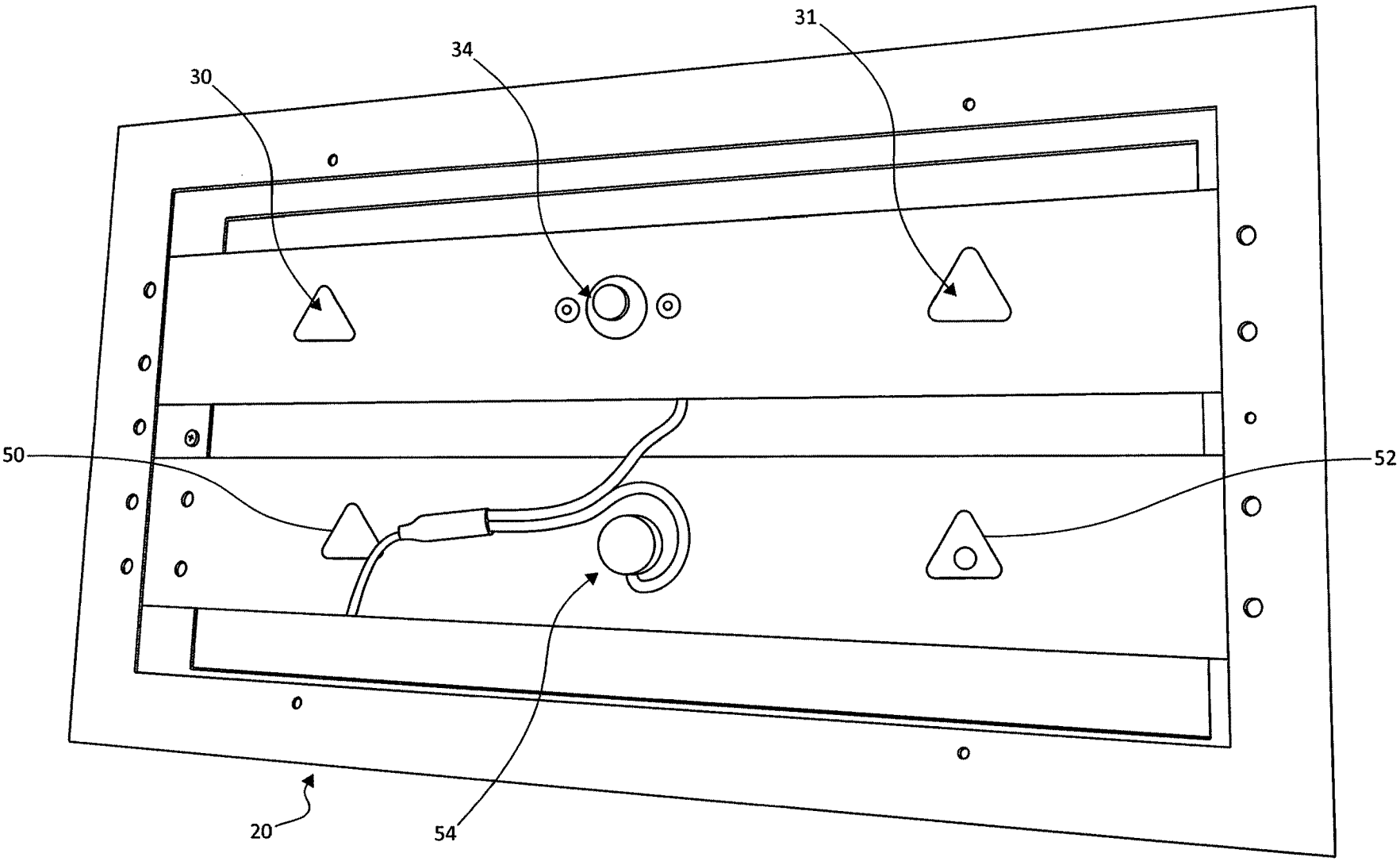
FIG. 3A is a bottom perspective view of a middle display panel of the middle display assembly of FIG. 3.

With reference to FIGS. 2, 3, and 3A, the first/bottom display panel 18 includes first and second male connectors 26, 28 projecting from an upper surface 18*b* thereof. The first and second male connectors 26, 28 may each be shafts or posts extending perpendicularly from the upper surface 18*b* of the first display panel 18. The first and second male connectors 26, 28 may have a circular shape, a triangular shape, a squared shape, or any other suitable shape. The first and second male connectors 26, 28 are configured to form a mechanical connection with first and second female connectors 30, 31 (FIG. 3A) of the second/middle display panel 20. The first and second female connectors 30 may be openings defined in a bottom end surface 20*b* of the second display panel 20 and may be shaped to complement the first and second male connectors 26, 28. In other aspects, the first and second female connectors 30 may be hollow posts or shafts that receive the first and second male connectors 26, 28 of the first display panel 18.

The first and second display panels 18, 20 each have an electrical connector 32, 34, such as, for example, a magnetic barrel connector, configured to form an electromechanical connection with one another. In aspects, the electrical connectors 32, 34 are magnetically attracted to one another to assist in joining the electrical connectors 32, 34. The electrical connector 32 of the first display panel 18 may be disposed between the first and second male connectors 26, 28, and the electrical connector 34 of the second display panel 20 may be disposed between the first and second female connectors 30. In further aspects, the first and second male connectors 26, 28 and the electrical connector 32 of the first display panel 18 may be aligned along a horizontally-extending longitudinal axis defined by the first display panel 18. The upper surface 48 of the second display panel 20 has a pair of male connectors 50, 52 and a magnetic electrical connector 54 disposed therebetween configured for connection with a respective female connector (not explicitly shown) and magnetic male electrical connector 57 (FIG. 5) of the third/top display panel 22.

The first display panel 18 further includes a pair of electrical receptacles 36, 38 disposed in a rear end portion 40 thereof configured for receipt of a corresponding pair of electrical posts 42, 44 of the vertical display panel 24. The vertical display panel 24 is oriented perpendicularly (e.g., vertically) relative to the first and second display panels 18, 20. The vertical display panel 24 has the pair of electrical posts 42, 44 extending downwardly therefrom. The posts 42, 44 are configured to convey electricity from the electrical receptacles 36, 38 of the first display panel 18 to a source of light (e.g., LEDs) in the vertical display panel 24. The electrical posts 42, 44 may be magnetic and the electrical receptacles 36, 38 may be magnetic, such that the electrical posts 42, 44 are magnetically attracted to the respective electrical receptacles 36, 38 to assist in assembly.

Figure 4:
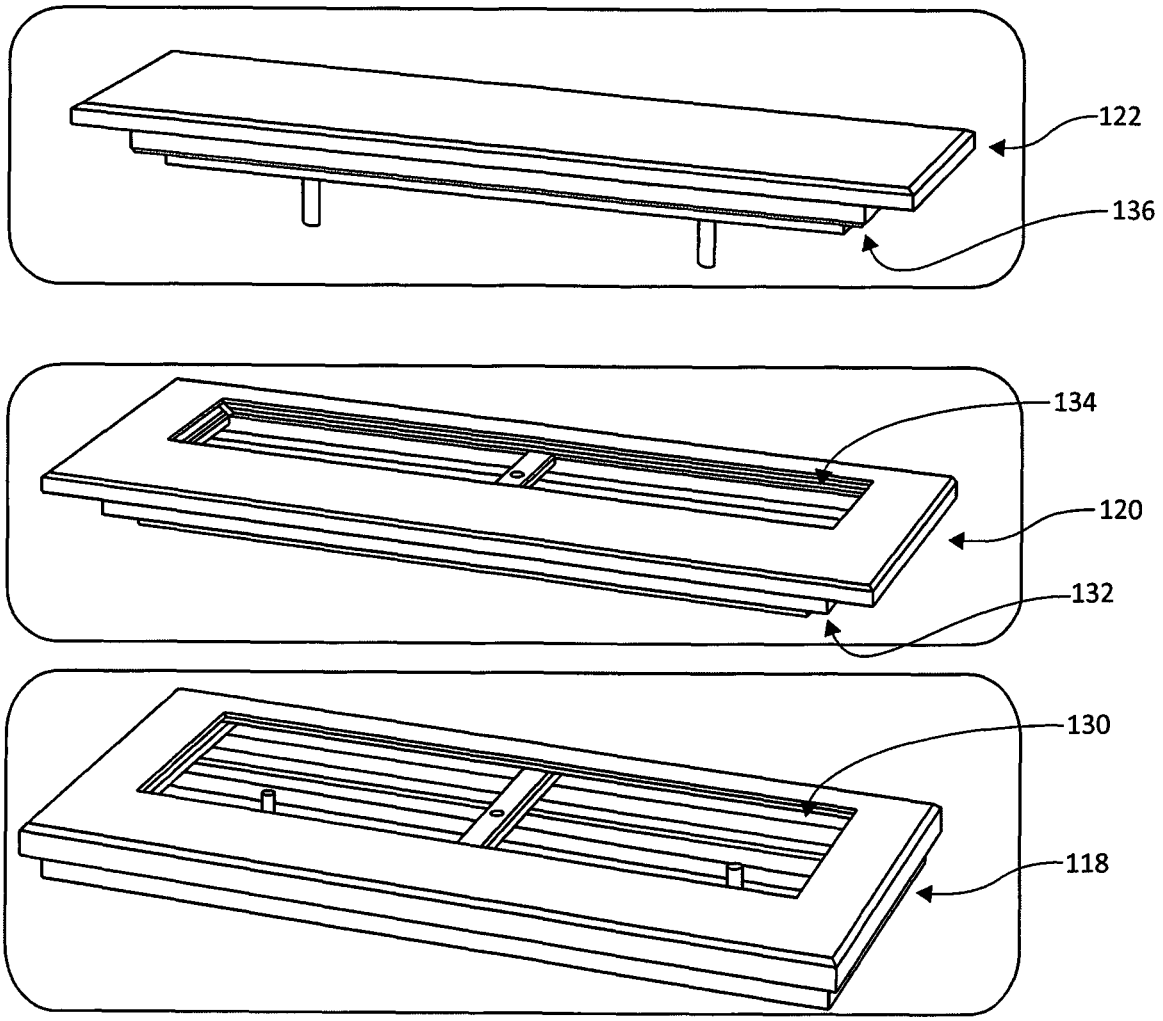
FIG. 4 is a top perspective view, with parts separated, of another embodiment of a cosmetic display assembly.

FIG. 4 illustrates an alternate embodiment of the horizontally-disposed display panels 118, 120, 122. The horizontally-disposed display panels 118, 120, 122 of FIG. 4 differ by having an additional mechanical feature for assembling the display panels 118, 120, 122 to one another. In particular, the first display panel 118 defines an elongated cavity 130 in the upper surface thereof, and the second display panel 120 has an elongated and stepped extension 132 protruding down from the bottom surface thereof. In aspects, the extension 132 may be a single extension rather than being stepped. The extension 132 of the second display panel 120 is configured for detachable receipt in the correspondingly-shaped cavity 130 of the first display panel 118. It is contemplated that the extension 132 may be detachably, frictionally retained in the cavity 130. The second display panel 120 may also have a cavity 134 defined in the upper surface thereof configured for removable receipt of an extension 136 of the third horizontal display panel 122.

Figure 5:
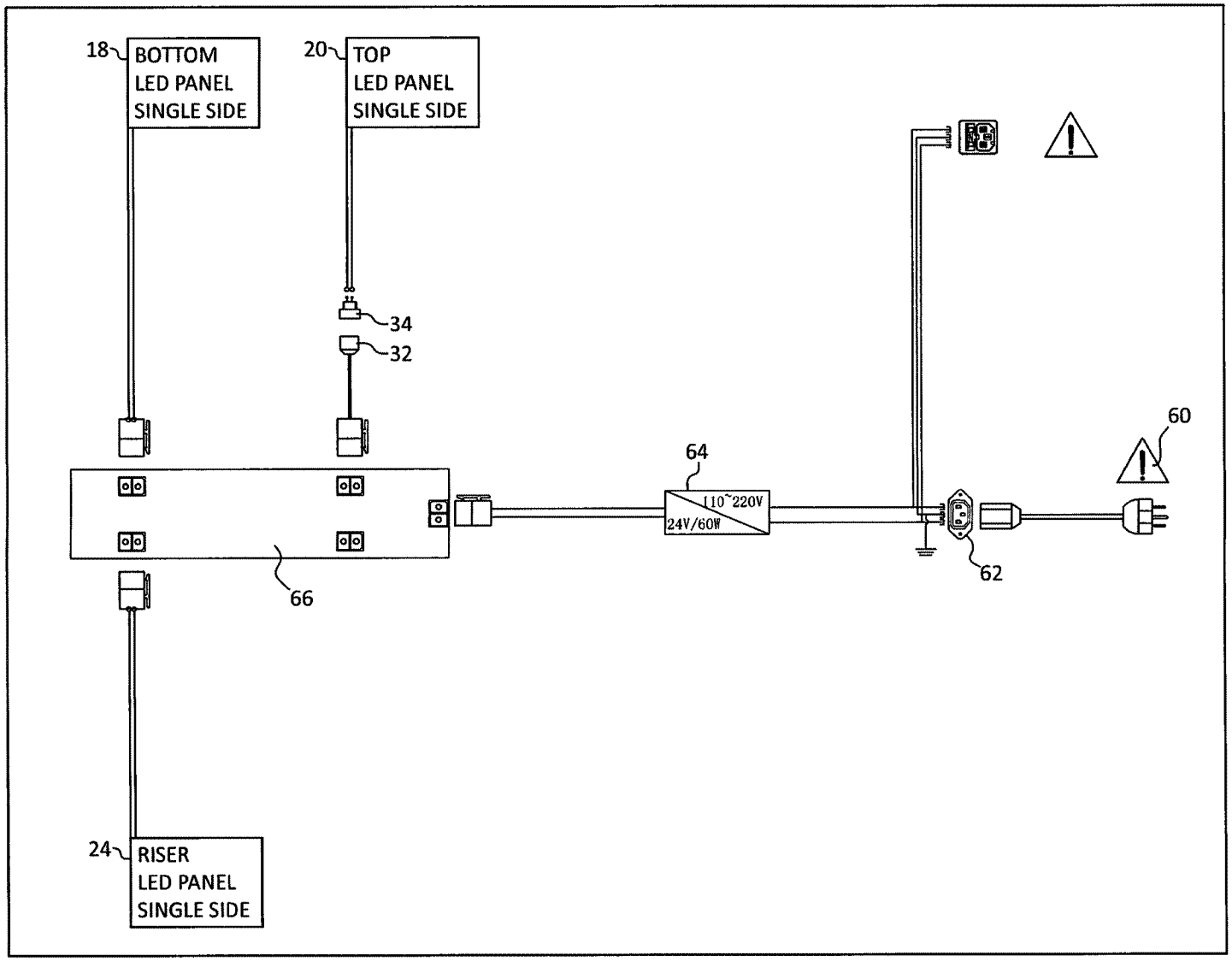
FIG. 5 is a schematic diagram illustrating an electrical connection between the components of the cosmetic display assembly.
Figure 6:
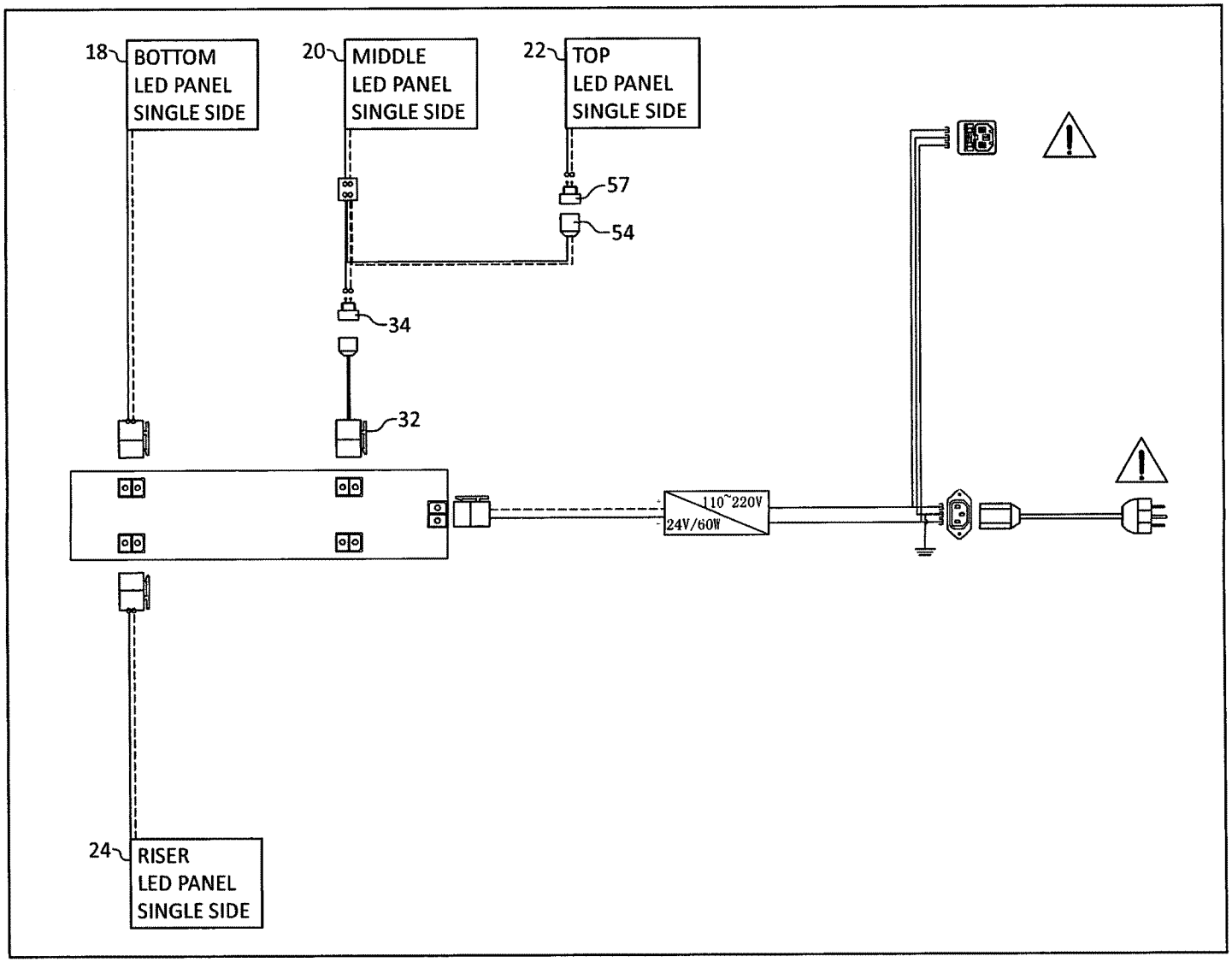
FIG. 6 is a schematic diagram illustrating further aspects of an electrical connection between components of the cosmetic display assembly.

With reference to FIGS. 2, 5, and 6, the display panels 18-24 are configured to receive power from a power source, such as, for example, a source of AC power 60. The first display panel 18 has an electrical port 62, such as, for example, an A/C inlet, configured to receive and transfer power directly from the power source 60 to the vertical display panel 24 and an A/C outlet 63. The first display panel 18 is also configured to transfer power from the power source 60 to the second display panel 20 via the electrical connectors 32, 34 of the first and second display panels 18, 20. The first display panel 18 may include an AC-DC converter 64 and a PCB connector 66 that transfer the DC power to the light sources in each of the first, second, and third display panels 18, 20, 22. In aspects, the first display panel 18 may include a transformer for a 24V DC/DC converter.

To assemble the cosmetic display assembly 12, the second display panel 20 is positioned above the first display panel 18 and the first and second male connectors 26, 28 of the first display panel 18 are inserted into the respective first and second female connectors 30 of the second display panel 20. While connecting the male and female connectors 26, 28, 30, the electrical connectors 32, 34 of the first and second display panels 18, 20 are also connected to one another, thereby creating an electromechanical connection between the first and second display panels 18, 20. Due to the electrical connectors 32, 34 being magnetic, the electrical connectors 32, 34 magnetically attract to one another during assembly to assist the user in electromechanically coupling the second/middle display panel 20 to the first/bottom display panel 18. The pair of electrical posts 42, 44 of the vertical display panel 24 is inserted into the pair of electrical receptacles 36, 38 of the first display panel 18, thereby creating an electromechanical connection between the first display panel 18 and the vertical display panel 24. With the display assembly 12 assembled, an electrical plug may be used to connect the electrical port 62 of the first display panel 18 with the source of power 60, whereby electricity is transferred from the first display panel 18 to the remainder of the display panels 20, 22, 24.

When using the display panels 118, 120, 122 shown in FIG. 4, assembly includes inserting the extension 132 of the second display panel 120 into the cavity 130 defined in the first display panel 118, and inserting the extension 136 of the third display panel 122 into the cavity 134 defined in the second display panel 120. While assembling the display panels 118, 120, 122 in this manner, the electrical connectors (not shown) and the mechanical connectors (not shown) of the display panels 118, 120, 122 are also connected in a similar manner as described above with respect to display panels 18-22.

Persons skilled in the art will understand that the structures and methods specifically described herein and shown in the accompanying figures are non-limiting exemplary embodiments, and that the description, disclosure, and figures should be construed merely as exemplary of particular embodiments. It is to be understood, therefore, that the disclosure is not limited to the precise embodiments described, and that various other changes and modifications may be effected by one skilled in the art without departing from the scope or spirit of the disclosure. Additionally, the elements and features shown or described in connection with certain embodiments may be combined with the elements and features of certain other embodiments without departing from the scope of the disclosure, and that such modifications and variations are also included within the scope of the disclosure. Accordingly, the subject matter of the disclosure is not limited by what has been particularly shown and described.

What is claimed is:

1. A cosmetic display assembly, comprising:

a first display panel including:

a first female connector or a first male connector;

an electrical connector; and an electrical receptacle;

a second display panel having the other of the first female connector or the first male connector, and an electrical connector configured to couple to the electrical connector of the first display panel, wherein the first and second display panels are configured to be stacked along a vertical axis; and a third display panel having a post extending downwardly therefrom, wherein the post is configured for receipt in the electrical receptacle of the first display panel.

2. The cosmetic display assembly according to claim 1, wherein the first male connector projects from an upper surface of the first display panel, and the first female connector is an opening defined in a lower surface of the second display panel.

3. The cosmetic display assembly according to claim 1, wherein the first male connector and the electrical connector of the first display panel are aligned along a horizontally-extending longitudinal axis defined by the first display panel.

4. The cosmetic display assembly according to claim 1, wherein the first display panel includes a second male connector, the electrical connector of the first display panel being disposed between the first and second male connectors.

5. The cosmetic display assembly according to claim 1, wherein each of the first, second, and third display panels is an LED-backlit LCD.

6. The cosmetic display assembly according to claim 1, wherein the first male connector has a triangular configuration, and the first female connector has a triangular configuration.

7. The cosmetic display assembly according to claim 1, wherein the first display panel has a first width, and the second display panel has a second width, less than the first width of the first display panel.

8. The cosmetic display assembly according to claim 1, wherein each of the first, second, and third display panels has a memory having stored therein instructions for displaying an image.

9. The cosmetic display assembly according to claim 1, wherein the first display panel has an electrical port configured to receive and transfer power directly to the third display panel, and to the second display panel via an electromechanical connection between the first and second display panels.

10. The cosmetic display assembly according to claim 1, wherein the first display panel defines cavity in an upper surface thereof, and the second display panel has an extension extending downwardly from a lower surface thereof, wherein the extension is configured for complementary receipt in the cavity.

11. The cosmetic display assembly according to claim 1, wherein the electrical connector of each of the first and second display panels is a barrel connector.

12. The cosmetic display assembly according to claim 1, wherein the electrical connector of each of the first and second display panels is magnetic, such that the electrical connectors are magnetically attracted to one another.

13. A method of assembling a cosmetic display assembly, comprising:

positioning a second display panel above a first display panel;

inserting first and second male connectors of the first display panel or the second display panel into respective first and second female connectors of the other of the first display panel or the second display panel;

connecting a first electrical connector of the first display panel with a second electrical connector of the second display panel, thereby creating an electromechanical connection between the first and second display panels; and inserting a support post of a third display panel into an electrical receptacle of the first display panel, thereby creating an electromechanical connection between the first and third display panels.

14. The method according to claim 13, further comprising inserting an extension extending downwardly from a lower surface of the second display panel into a cavity defined in an upper surface of the first display panel.

15. The method according to claim 13, further comprising connecting an electrical port of the first display panel with a source of power, whereby electricity is transferred from the first display panel to the second and third display panels.

16. The method according to claim 13, wherein the first and second electrical connectors are magnetic, such that the first and second electrical connectors are magnetically attracted to one another.

* * * * *